US005632439A

United States Patent [19]

Yucknut et al.

[11] Patent Number: 5,632,439

[45] Date of Patent: May 27, 1997

[54] ONE-PIECE BLAND/SHROUD AND DISPLAY CASE

[75] Inventors: Stephen M. Yucknut, Danbury, Conn.; Panagiotis Kinigakis, Princeton Junction, N.J.

[73] Assignee: Kraft Foods, Inc., North field, Ill.

[21] Appl. No.: 497,576

[22] Filed: Jun. 30, 1995

Related U.S. Application Data

[63] Continuation-in-part of Ser. No. 424,952, Apr. 19, 1995, abandoned.

[51] Int. Cl.[6] ..... B65D 25/04

[52] U.S. Cl. ..... 229/120.18; 229/120.37; 206/497; 206/814

[58] Field of Search ..... 206/497, 561, 206/814; 229/120.18, 120.37, 918

[56] References Cited

U.S. PATENT DOCUMENTS

| | | | |
|---|---|---|---|
| 2,700,499 | 1/1955 | Durand | 229/120.18 |
| 2,772,610 | 12/1956 | Arneson | 229/120.34 |
| 3,088,648 | 5/1963 | Fobiano | 229/120.18 |
| 3,348,667 | 10/1967 | Beeby | 229/120.37 |
| 3,363,824 | 1/1968 | Murata | 229/120.18 |
| 3,365,110 | 1/1968 | Salomone | 229/15 |
| 3,532,214 | 10/1970 | Helms | 206/65 |
| 4,062,448 | 12/1977 | Meighan | 206/432 |
| 4,328,922 | 5/1982 | Hirata | 229/27 |
| 4,625,864 | 12/1986 | Negrelli | 206/427 |
| 4,641,746 | 2/1987 | Dornbusch et al. | 206/44 R |
| 4,848,651 | 7/1989 | Hartness | 229/125.33 |
| 4,919,266 | 4/1990 | McIntosh, Jr. et al. | 206/434 |
| 5,372,299 | 12/1994 | Edgerton, Jr. et al. | 229/120.18 |
| 5,443,205 | 8/1995 | Robotham et al. | 229/243 |
| 5,447,225 | 9/1995 | Gunn et al. | 206/44.12 |
| 5,487,504 | 1/1996 | Baird | 229/120.18 |

*Primary Examiner*—David T. Fidei

*Attorney, Agent, or Firm*—Thomas R. Savoie; Thomas A. Marcoux

[57] ABSTRACT

A one-piece blank which is folded to provide a shroud is used in conjunction with a bottom tray and securing mechanism to form a display case for enclosing an array of packages. The one-piece blank or shroud formed thereby includes a central top panel and a pair of side panels hinged thereto so that when the side panels are bent along the hinge lines to form the shroud the side panels are located adjacent respective opposed side faces of the array of packages. The blank or shroud also includes a pair of opposed projecting portions hinged to each side panel with a central hinge line therein to define a reinforcing panel and a leg panel so that when the reinforcing panels of each pair of projecting portions are bent back onto the associated the side panel the leg panels are bent perpendicular to the reinforcing panels to come together and to form a leg which is inserted laterally into the side face of the array of packages. Preferably, the blank or shroud includes a pair of squaring panels foldably attached to respective other sides of the central panel which are bent back and secured to the central panel so that the squaring panels strengthen the central panel. The reinforcing panels are also preferably immovably secured to the side panels adjacent thereto.

9 Claims, 2 Drawing Sheets

ONE-PIECE BLAND/SHROUD AND DISPLAY CASE

RELATED APPLICATION

This application is a continuation-in-part of Ser. No. 08/424,952, filed Apr. 19, 1995 and now abandoned.

FIELD OF THE INVENTION

The present invention relates generally to the protection of packages shipped in groups, and more particularly to a blank/shroud and display case using this shroud which is used to protect an array of packages while leaving two opposed sides of the array unenclosed.

BACKGROUND OF THE INVENTION

When shipping products or packages (hereafter packages) which have little strength, it is necessary to protect the packages with a suitably strong shipping/storage container. Typically, it is desired to use corrugated board for such containers, which is a relatively cheap material and lends itself to automation. However, it may also be desirable to display the package in the container (for ready identification by the user) and to afford easy access to the packages. Various containers have been disclosed in the art for this purpose.

For example, KOOL-AID BURSTS® (comprising a fruit-flavored beverage in a plastic bottle with a flexible neck and twist-off top) are now shipped in a shrink-wrapped, display case comprising a top and bottom, corrugated, cardboard tray about a 4×2 array of six-packs of the KOOL-AID BURSTS®. A supporting divider is also provided between the array to vertically support the display case as the KOOL-AID BURSTS® bottles themselves have little vertical strength (as the twist-off tops and necks are flexible). However, the assembly of such display cases is not readily automated and hence is labor intensive.

SUMMARY OF THE INVENTION

In accordance with the present invention, a one-piece blank which is foldable to provide a shroud used in conjunction with a bottom tray is provided to enclose an array of packages and to provide vertical support for an assembled display case. The one-piece blank or shroud formed thereby includes a central top panel which is rectangular shaped so as to overlay a top of the array of packages. The top panel defines a pair of opposed first sides extending parallel to an x-axis and a pair of opposed second sides extending parallel to a y-axis. The blank or shroud also includes a pair of side panels, each side panel including a respective first hinge line parallel to the x-axis attaching the side panel to a respective first side so that when the side panels are bent along the first hinge lines to form the shroud the side panels are located adjacent respective opposed side faces of the array of packages. The blank or shroud further includes a pair of opposed projecting portions for each side panel extending parallel to the x-axis and beyond an adjacent respective second side. Each of the projecting portions includes (a) a second hinge line parallel with the y-axis attaching the projecting portion to the associated side panel, and (b) a third hinge line therein parallel to the y-axis to define a reinforcing panel and a leg panel. The reinforcing panel extends parallel to the x-axis for a distance slightly less than ½ of the distance that the side panel extends parallel to the x-axis so that when the reinforcing panels of each pair of projecting portions are bent back onto the associated side panel along the second hinge lines the associated leg panels are bent perpendicular to the reinforcing panels along the third hinge lines to come together and to form a leg which is inserted laterally into the side face of the array of packages.

Preferably, the blank or shroud includes a pair of squaring panels attached to respective second sides along a respective fourth hinge line parallel to the y-axis. These squaring panels are bent back along the fourth hinge lines and secured to the central panel so that the squaring panels strengthen the central panel. Also preferably provided is a securing means, such as lines of adhesive, for immovably securing the reinforcing panels to the side panels adjacent thereto. Although not usually necessary, it is also contemplated that similar securing means for immovably securing associated leg panels of a pair of reinforcing panels to one another may be employed.

In a preferred embodiment, the side panels are attached completely along a length of the associated the first side of the central panel. In addition, the side panels and the projecting portions are rectangularly shaped, and the third hinge lines are perforated score lines. A space is also preferably provided between associated adjacent opposed sides of the reinforcing panel and of the squaring panels.

Where a display case is provided, the display case includes a bottom tray on which a bottom of the array and the distal or bottom edge of the shroud rest. A securing means for securing the tray and the shroud together about the array of packages, such as a shrink wrap, is then used to form a unitary case suitable for shipping.

Also in accordance with the present invention, the one-piece formed shroud includes a central top panel which is rectangular shaped and which overlays the top of the array of packages with the top panel defining a pair of opposed first sides and a pair of opposed second sides. The formed shroud then further includes a pair of opposed T-shaped panels. Each T-shaped panel includes (a) a side panel forming a cross portion of the T-shaped panel with the side panel engaging an associated side face of the array, (b) a single leg forming a leg of the T-shaped panel with the leg being located between adjacent packages of the array as the associated side panel engages the side face of the array, and (c) a first hinge connection of the side panel to an associated first side of the central top panel.

It will be appreciated that the formed panel is preferably made of a corrugated cardboard material and that a pair of squaring panels are attached to respective second sides along a respective second hinge line with the squaring panels being bent back along the second hinge lines and secured to the central panel so that the squaring panels strengthen the central panel. Also, each side panel includes a respective pair of reinforcing panels for reinforcing the associated side panel with each reinforcing panel including a third hinge line which connects the reinforcing panel with the associated side panel whereby each reinforcing panel of a pair is bent back onto the side panel along the third hinge line and securing means immovably attaches the reinforcing panels to the side panels adjacent thereto. Further, each leg includes a pair of respective leg panels with each leg panel including a fourth hinge line which connects the leg panel with an associated reinforcing panel and with each leg panel of a pair being bent perpendicular to the associated reinforcing panel along the fourth hinge line.

It is an object of the present invention to provide a shroud or display case which provides a maximum amount of package access while still affording sufficient protection for the packages.

It is also an object of the present invention to provide a shroud or display case with a maximum package display.

It is a further object of the present invention to provide a shroud and display case whose construction and filling are automatable.

It is another object of the present invention to provide a shroud and display case which have high strength to protect the packages during distribution and warehousing.

It is also an object of this invention to provide a display case which has high resistance to compression at all four corners.

It is a further object of this invention to provide a display case with a high level of protection for the enclosed packages while minimizing the use of corrugated board.

It is yet another object of the present invention to provide a shroud and display case which are capable of supporting high quality graphics identifying the packages contained therein.

Other features and objects of the present invention are stated in or apparent from detailed descriptions of presently preferred embodiments of the invention found hereinbelow.

DETAILED DESCRIPTION OF THE PREFERRED EMBODIMENTS

Figure 1:
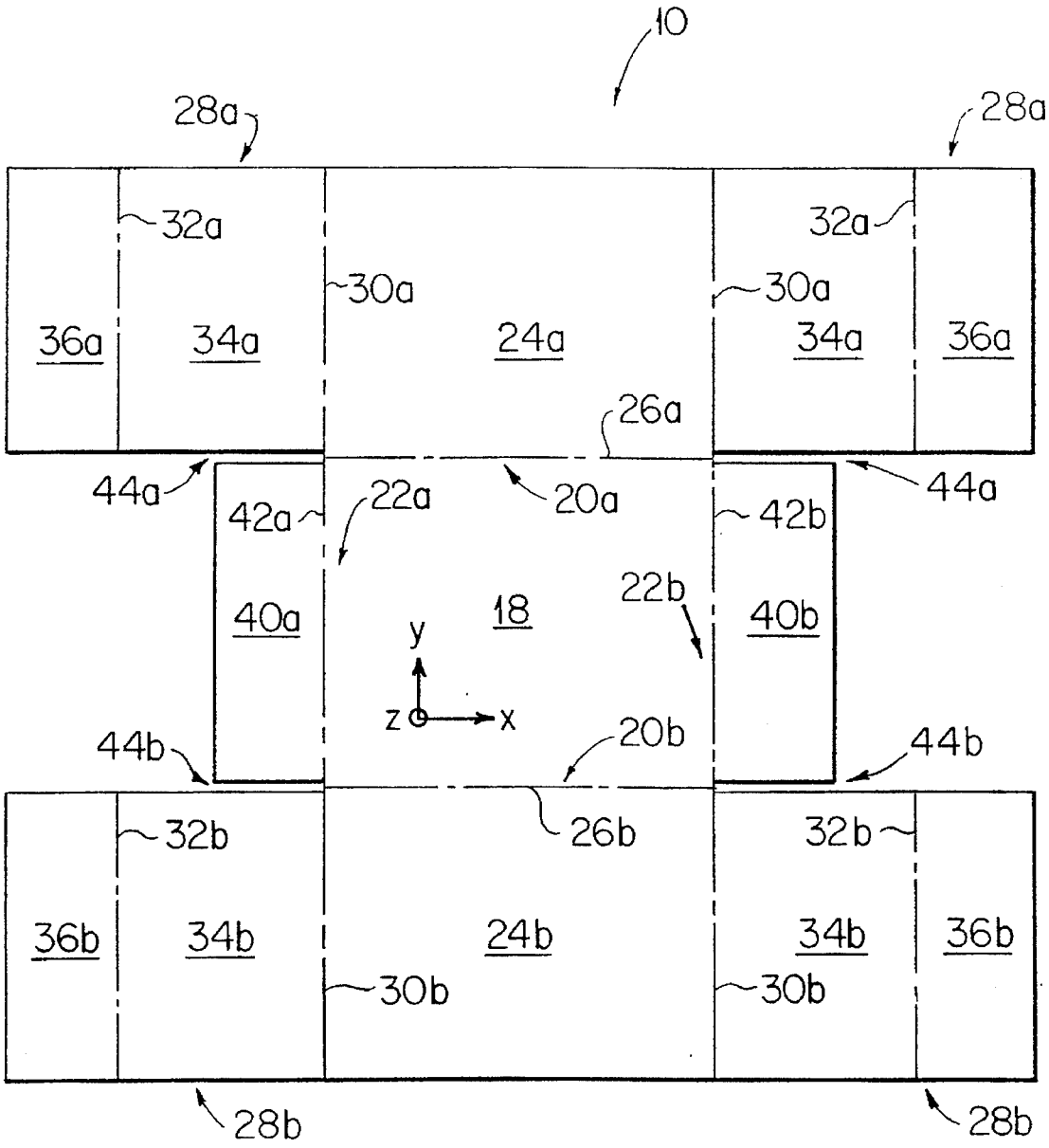
FIG. 1 is a bottom plan view of a one-piece blank from which a shroud is erected according of the present invention.

With reference now to the drawings in which like numerals represent like elements throughout the views, a one-piece, die-cut blank 10 of corrugated board or the like is depicted in FIG. 1. It will be appreciated that die-cut blank 10 is foldable to form a shroud 12 as depicted partially formed in FIG. 2 and fully formed in FIG. 3 for covering a 4×2 array 14 of packages 16. Packages 16 are, for example, six-packs of KOOL-AID BURSTS®. Blank 10 includes a central top panel 18 which is designed to form a top of shroud 12. Central panel 18 is generally rectangular in shape and thus defines a pair of first sides 20*a* and 20*b* extending parallel to an x-axis and a pair of second sides 22*a* and 22*b* extending parallel to a y-axis. A z-axis is oriented to be perpendicular to an x-y plane forward by the x-axis and the y-axis. It will be appreciated that axes x, y and z are used as a convenient reference for describing the elements and locations thereof of the present invention and that these axes are not otherwise part of the blank 10 or of the invention.

Blank 10 also includes a pair of rectangular side panels 24*a* and 24*b*. As side panels 24*a* and 24*b* are otherwise identical, only side panel 24*a* will be described in detail, with the similar elements of side panel 24*b* being depicted with the same identifying numbers but with a "b" suffix rather than an "a" suffix. Side panel 24*a* includes a hinge or score line 26*a* parallel to the x-axis attaching side panel 24*a* foldably along hinge line 26*a* to first side 20*a* of central panel 18 along a length thereof.

Each side panel 24*a* and 24*b* also includes a respective pair of rectangular projecting portions 28*a* and 28*b* which are also identical to one another so that only one projecting portion 28*a* is described in detail. Projecting portion 28*a* extends parallel to the x-axis from side panel 24*a* and beyond the adjacent first side 20*a* or 20*b*. Each projecting portion 28*a* includes a second hinge or score line 30*a* parallel with the y-axis foldably attaching projecting portion 28*a* to side panel 24*a*. In addition, each projecting portion 28*a* also includes a perforated hinge or score line 32*a* parallel to the y-axis. Perforated hinge line 32*a* divides projecting portion 28*a* into a reinforcing panel 34*a* and a leg panel 36*a*, and the perforations of hinge line 32*a* make it possible to more easily fold leg panel 36*a* 90° thereabout relative to reinforcing panel 34*a*. It will be appreciated that reinforcing panels 34*a* extend parallel to the x-axis for a distance which is slightly (typically by a little more than the thickness of leg panel 36*a*) less than ½ of the distance that side panel 24*a* extends along the x-axis. Thus, when reinforcing panels 34*a* of side panel 24*a* are bent back onto side panel 24*a* along hinge lines 30*a* as shown in FIGS. 2 and 3, leg panels 36*a* are bent perpendicular to reinforcing panels 34*a* along hinge lines 32*a* to come together and to form a leg 38*a*.

Blank 10 further includes squaring panels 40*a* and 40*b* attached to a respective second side 22*a* or 22*b* along a respective hinge or score line 42*a* or 42*b* which is parallel to the y-axis. When squaring panels 40*a* and 40*b* are bent along hinge lines 42*a* and 42*b* back onto central panel 18 as shown in FIG. 2, squaring panels 40*a* and 40*b* serve to strengthen central panel 18 and help central panel 18 maintain its rectangular shape, and help the formed shroud and assembled display case maintain its squareness. It will also be appreciated that a space 44*a* or 44*b* is provided between sides of reinforcing panels 34*a*, 34*b* adjacent to sides of squaring panels 40*a*, 40*b* to provide room for forming of shroud 12 as shown in FIG. 3.

Figure 2:
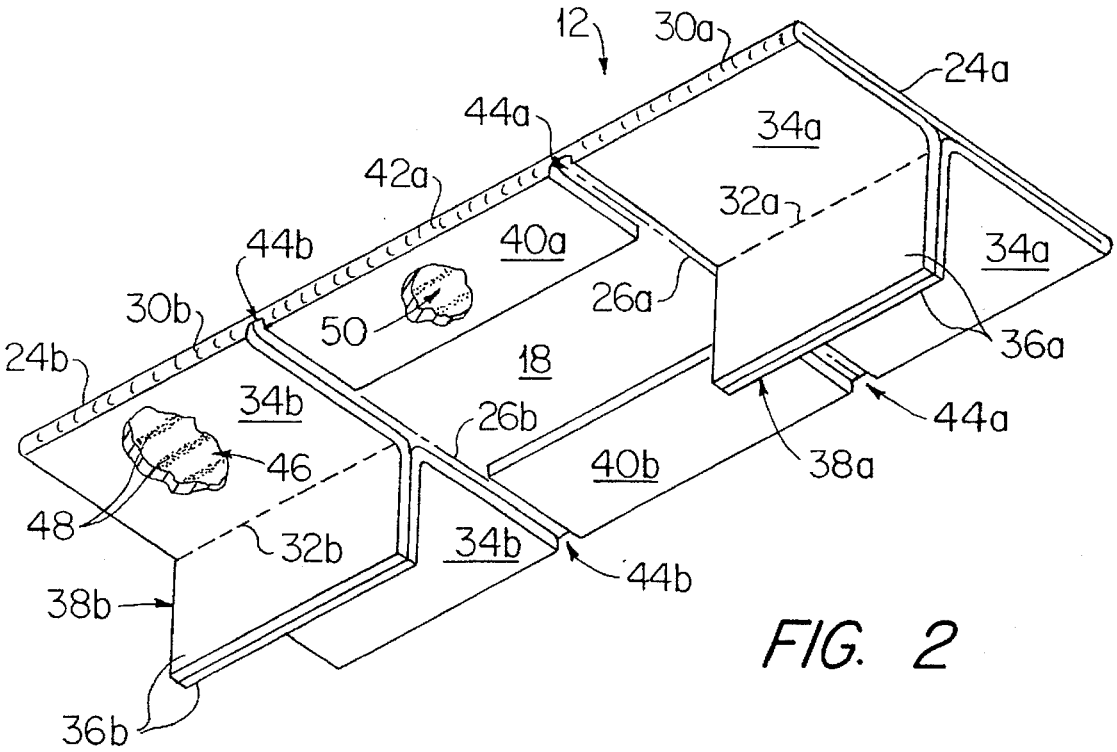
FIG. 2 is a bottom perspective view with portions broken away of the one-piece blank depicted in FIG. 1 partially folded into a shroud having a pair of opposed T-shaped panels according to the present invention.

Depicted in FIG. 2 is shroud 12 which has been partially formed from blank 10. As shown, reinforcing panel 34*b* on the left side of the figure (as well as the other reinforcing panels 34*a* and 34*b*) has been bent back along hinge line 30*b* onto side panel 24*b* and immovably secured to the overlying portion of side panel 24*b* by a securing means 46. Securing means 46 is suitably a series of hot melt adhesive or glue strips 48 where shroud 12 is made of a corrugated board material, though obviously other securing means known in the art could also be used. In a similar manner, it will be appreciated that squaring panels 40*a* and 40*b* are immovably secured to the overlying portion of central panel 18 by a securing means 50.

Figure 3:
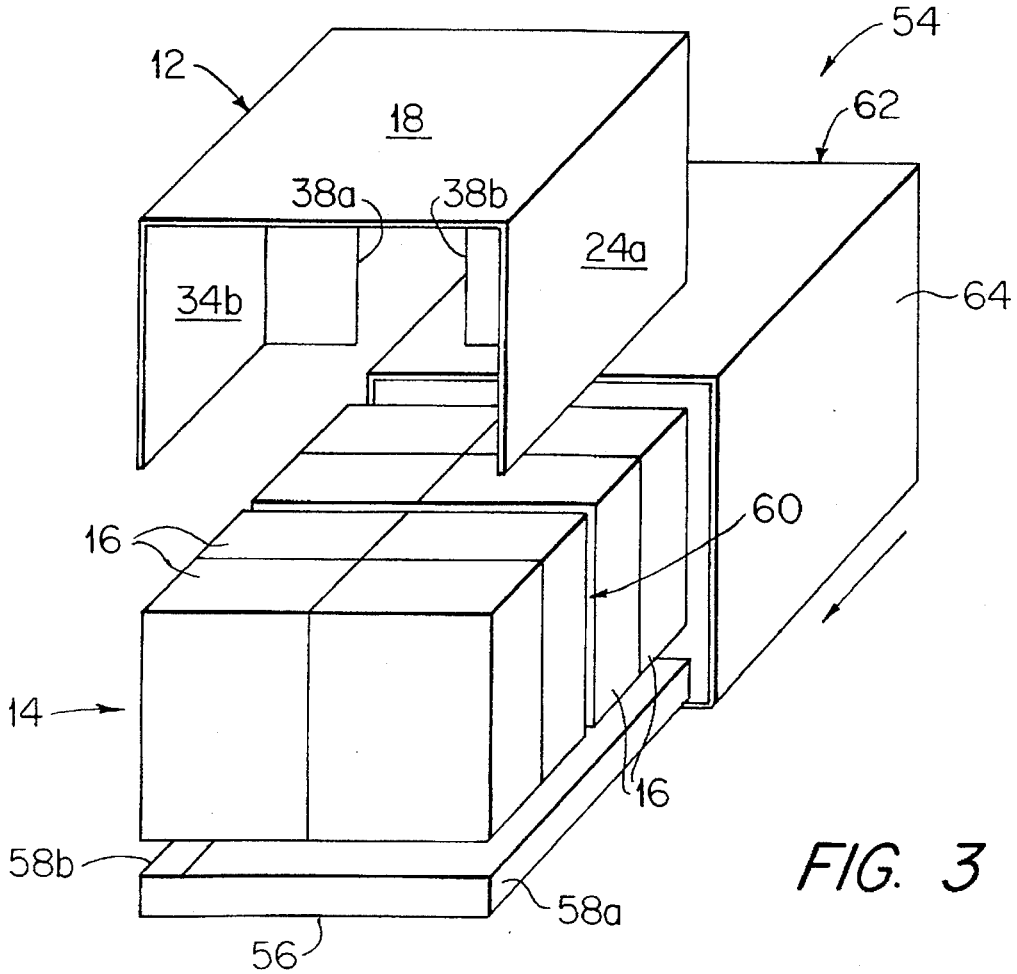
FIG. 3 is a schematic top perspective view of the one-piece blank depicted in FIG. 1 completely folded into a shroud and being assembled into a display case according to the present invention.

While shroud 12 is capable of serving as a protective top and side for array 14 of packages 16 if packages 16 have a suitable bottom, shroud 12 is preferably used as part of an overall display case 54 depicted in an unassembled configuration in FIG. 3. Display case 54 obviously includes shroud 12, which has been reconfigured from the configuration depicted in FIG. 2 by the bending opposed T-shaped panels (with side panels 24*a* and 24*b*, reinforcing panels 34*a* and 34*b* secured thereto and with legs 38*a* and 38*b* formed as discussed above) along hinge lines 26*a* and 26*b*, respectively, to form shroud 12 into its final shape. During this final bending along hinge lines 26*a* and 26*b*, it will be appreciated that spaces 44*a* and 44*b* provide clearance between the adjacent side edges of reinforcing panels 34*a*, 34*b* and of squaring panels 40*a*, 40*b* so that there is no interference between these side edges as the folding takes place.

Display case 54 also includes a bottom tray 56 which is also suitably formed of a corrugated board material in any manner well known in the art. It will be appreciated that bottom tray 56 is sized to receive array 14 therein with clearance between upstanding sides 58*a* and 58*b* of bottom tray 56 and the sides of array 14 so that side panels 24*a* and 24*b* can fit between upstanding sides 58*a* and 58*b* of bottom tray 56 and the sides of array 14. In addition, while array 14 is formed overall as a 4×2 array of eight packages 16, it will be seen that array 14 is divided into two 2×2 arrays to accommodate the insertion of legs 36*a* and 36*b*. Thus, a small space 60 is centrally created between the two 2×2 arrays in which legs 36*a* and 36*b* are trapped. Finally, display case 54 is completed by suitably securing array 14, shroud 12 and bottom tray 56 together with a suitable securing means 62 known in the art. A suitable securing means 62 is a shrink wrap sleeve 64 shown in the unshrunken condition, although other securing means such as full shrink wrap, straps or the like could also be used.

After shrink wrap 64 is shrunk around array 14, shroud 12 and bottom tray 56, it will be appreciated that display case 54 so formed is completed. Display case 56 then has two ends through which packages 16 are easily viewable, either directly or through a transparent, shrink-wrap film. In addition, packages 16 are also easily accessible by the user, either individually by breaking part of shrink wrap 64 or completely by removing shrink wrap 64 and then lifting shroud 12 from array 14. It will also be appreciated that central panel 18 as well as side panels 24*a* and 24*b* also provide a suitable surface for high quality graphics as desired.

Prior to removal of shrink wrap 64, display case 54 provides a sturdy container for packages 16 which are stackable. Legs 38*a* and 38*b* are double thickness and trapped between adjacent packages 16, providing obvious vertical support. Further, the double thickness of side panels 24*a* and 24*b* reinforced by reinforcing panels 34*a* and 34*b* also provide vertical support as well as side protection. The overall shape of shroud 12 is also maintained: as central panel is maintained in its rectangular configuration by squaring panels 40*a* and 40*b*, as side panels 24*a* and 24*b* are reinforced by reinforcing panels 34*a* and 34*b*, and as legs 38*a* and 38*b* are trapped in array 14 and engage bottom tray 56 and top panel 18. It will also be appreciated that all eight corners of array 14 are suitably protected against compressive forces or shocks, such as would be encountered were a case to be dropped, by a double thickness of material due to the configuration and location of shroud 12. Those skilled in the art will appreciate that the display case of this invention utilizes a relatively small amount corrugated board and that the cost to strength ratio of the case is thereby minimized.

While the present invention has been described with respect to exemplary embodiments thereof, it will be understood by those of ordinary skill in the art that variations and modifications can be effected within the scope and spirit of the invention.

What is claimed is:

1. A one-piece shroud for enclosing a top and two opposed side faces of an array of packages while leaving the other two opposed side faces of the array unenclosed comprising:

(a) a central top panel which is rectangular shaped and which overlays a top of the array of packages, said top panel defining a pair of opposed first sides extending parallel to an x-axis and a pair of opposed second sides extending parallel to a y-axis;

(b) a pair of side panels attached to respective first sides along a respective first hinge line parallel to the x-axis, said side panels being bent along said first hinge lines so that said side panels engage opposed sides of the array of packages; and (c) a pair of opposed projecting portions for each said side panel extending parallel to the x-axis and beyond an adjacent respective said second side, each said projecting portion being attached to the associated said side panel along a second hinge line parallel with the y-axis, and each said projecting portion including a third hinge line therein parallel to the y-axis to define a reinforcing panel and a leg panel, said reinforcing panel extending parallel to the x-axis for a distance less than ½ of a distance that said side panel extends parallel to the x-axis, said reinforcing panels being bent back onto and unmovably secured to said side panels along said second hinge lines and said leg panels being bent perpendicular to said reinforcing panels along said third hinge lines so that said leg panels come together and form a single leg which is inserted laterally into the array of packages.

2. A one-piece shroud as claimed in claim 1 and further including a pair of squaring panels, a pair of fourth hinge lines parallel to the y-axis which attach a respective said squaring panel to a respective said second side and which allow said squaring panels to be bent back along said fourth hinge lines onto said central panel, and a securing means for immovably securing said squaring panels to said central panel so that said squaring panels strengthen said central panel.

3. A one-piece shroud as claimed in claim 1 wherein said side panels are attached completely along a length of the associated said first side of said central panel.

4. A one-piece shroud as claimed in claim 1 wherein said side panels and said projecting portions are rectangularly shaped.

5. A one-piece shroud as claimed in claim 1 wherein a space is provided between associated adjacent opposed sides of said reinforcing panel and of said squaring panels.

6. A one-piece shroud for enclosing a top and two opposed side faces of an array of packages while leaving the other two opposed side faces of the array unenclosed comprising:

a central top panel which is rectangular-shaped and which overlays a top of the array of packages, said top panel defining a pair of opposed first sides and a pair of opposed second sides;

a pair of opposed T-shaped panels, each said T-shaped panel including a side panel forming a cross portion of the T-shaped panel, said side panel attached completely along a length of the associated first side of said central panel by means of a hinge connection and said side panel engaging an associated side face of the array, wherein each said side panel includes a respective pair of reinforcing panels for reinforcing the associated said side panel, each said reinforcing panel including a hinge line which connects said reinforcing panel with the associated said side panel, with each said reinforcing panel of a pair being bent back onto said side panel along said hinge line and securing means for immovably securing said reinforcing panels to said side panels adjacent thereto a single leg forming a rectangular-shaped leg portion of the T-shaped panel, said leg being located between adjacent packages of the array as the associated said side panel engages the side face of the array, and wherein each said leg includes a pair of respective leg panels, each said leg panel including a leg hinge line which connects said leg panel with an associated said reinforcing panel, with each said leg panel of a pair being bent perpendicular to the associated said reinforcing panel along said leg hinge line.

7. The one-piece shroud of claim 6 wherein the securing means for ummovably securing said reinforcing panels to said side panels are a series of hot melt adhesive or glue strips.

8. The one-piece shroud of claim 1 wherein the reinforcing panels are immovably secured to said side panels by means of a series of hot melt adhesive or glue strips.

9. A one-piece shroud as claimed in claim 6 which is made of corrugated board material and which further includes:

a pair of squaring panels attached to respective second sides of said central panel along respective hinge lines, said squaring panels being bent back along said hinge lines and secured to said central panel so that said squaring panels strengthen and provide squareness to said central panel.

* * * * *